US010697708B2

(12) United States Patent
Lewandowski

(10) Patent No.: US 10,697,708 B2
(45) Date of Patent: Jun. 30, 2020

(54) HEAT EXCHANGERS

(71) Applicant: Hamilton Sundstrand Corporation, Charlotte, NC (US)

(72) Inventor: Rafal Lewandowski, Zarow (PL)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 121 days.

(21) Appl. No.: 15/489,964

(22) Filed: Apr. 18, 2017

(65) Prior Publication Data

US 2017/0299273 A1 Oct. 19, 2017

(30) Foreign Application Priority Data

Apr. 18, 2016 (EP) ..... 16165887

(51) Int. Cl.
*F28D 7/00* (2006.01)
*F28D 9/00* (2006.01)
(Continued)

(52) U.S. Cl.
CPC ..... *F28D 7/0066* (2013.01); *F28D 7/10* (2013.01); *F28D 7/12* (2013.01); *F28D 9/00* (2013.01);
(Continued)

(58) Field of Classification Search
CPC ..... F28D 7/10; F28D 7/12; F28D 9/00; F28D 7/026; F28D 9/005; F28D 9/04;
(Continued)

(56) References Cited

U.S. PATENT DOCUMENTS 2,217,316 A * 10/1940 Kallsteinus ..... F28D 9/04 165/167
2,690,328 A * 9/1954 Keesling ..... F28F 7/02 165/166
(Continued)

FOREIGN PATENT DOCUMENTS

AT 304596 B * 1/1973 ..... F28D 9/04
CA 2801607 A1 * 12/2011 ..... F01N 3/2889
(Continued)

OTHER PUBLICATIONS

JP 60238690 A Machine Translation—Retrieved Nov. 2018 (Year: 1985).*
(Continued)

*Primary Examiner* — Len Tran
*Assistant Examiner* — Jenna M Hopkins
(74) *Attorney, Agent, or Firm* — Cantor Colburn LLP

(57) ABSTRACT

A plate fin heat exchanger comprises a circular section tubular shell. The shell comprises a plurality of first shell openings arranged along a length of the shell and a plurality of second shell openings arranged along a length of the shell. A first fluid plenum is provided on the shell in fluid communication with the first shell openings. A second fluid plenum is provided on the shell in fluid communication with the second shell openings. The heat exchanger further comprises a core extending axially within the tubular shell. The core comprises an axially extending first core passage and a second axially extending core passage isolated from the first core passage.

15 Claims, 7 Drawing Sheets

(51) Int. Cl.

| | |
|---|---|
| ***F28F 9/02*** | (2006.01) |
| ***F28D 7/10*** | (2006.01) |
| ***F28F 9/22*** | (2006.01) |
| ***F28D 7/12*** | (2006.01) |
| ***F28D 9/04*** | (2006.01) |

(52) U.S. Cl.
CPC ..... *F28D 9/005* (2013.01); *F28D 9/0006* (2013.01); *F28D 9/0012* (2013.01); *F28D 9/04* (2013.01); *F28F 9/026* (2013.01); *F28F 9/0273* (2013.01); *F28F 9/22* (2013.01); *F28F 2009/226* (2013.01); *F28F 2009/228* (2013.01); *F28F 2210/00* (2013.01)

(58) Field of Classification Search
CPC .... F28F 2210/00; F28F 9/22; F28F 2009/226; F28F 2009/228; F28F 9/0273
See application file for complete search history.

(56) References Cited

U.S. PATENT DOCUMENTS

| | | | | | |
|---|---|---|---|---|---|
| 3,854,530 | A * | 12/1974 | Jouet | B21D 53/027 | 165/163 |
| 3,865,185 | A * | 2/1975 | Ostbo | F28F 3/086 | 165/165 |
| 4,360,059 | A | 11/1982 | Funke | | |
| 5,727,623 | A * | 3/1998 | Yoshioka | B01D 53/265 | 165/113 |
| 5,787,974 | A * | 8/1998 | Pennington | F28D 9/04 | 165/164 |
| 6,446,712 | B1 * | 9/2002 | Wu | F28D 9/0012 | 165/167 |
| 6,513,583 | B1 * | 2/2003 | Hughes | F28D 7/1607 | 165/159 |
| 6,789,616 | B2 * | 9/2004 | Nakano | F28D 9/0018 | 165/165 |
| 6,997,247 | B2 | 2/2006 | Malone et al. | | |
| 7,631,688 | B2 | 12/2009 | Brost et al. | | |
| 8,210,247 | B2 * | 7/2012 | Blomgren | F28D 9/0012 | 165/157 |
| 8,420,032 | B1 * | 4/2013 | Ermanoski | B01J 8/087 | 422/630 |
| 9,182,176 | B2 * | 11/2015 | Sei | F28D 9/0012 | |
| 10,107,556 | B2 * | 10/2018 | Buckrell | F28D 9/0012 | |
| 10,330,208 | B2 * | 6/2019 | Takamatsu | F24F 11/89 | |
| 2002/0092646 | A1 * | 7/2002 | Kuhn | F28D 7/04 | 165/163 |
| 2003/0183374 | A1 * | 10/2003 | Voss | B01D 5/0015 | 165/110 |
| 2005/0274329 | A1 * | 12/2005 | Brewster | F24D 1/005 | 122/36 |
| 2006/0118284 | A1 * | 6/2006 | Tauren | F28D 9/0006 | 165/157 |
| 2006/0151147 | A1 * | 7/2006 | Symonds | F28D 9/0012 | 165/11.1 |
| 2006/0237184 | A1 * | 10/2006 | Peric | F16K 15/144 | 165/283 |
| 2010/0084111 | A1 * | 4/2010 | Jaeger | B63H 21/383 | 165/41 |
| 2013/0276448 | A1 * | 10/2013 | Weigold | F22G 7/14 | 60/648 |
| 2015/0000327 | A1 * | 1/2015 | Kakehashi | F25D 17/02 | 62/434 |
| 2015/0300745 | A1 * | 10/2015 | Kolb | F28F 13/12 | 165/156 |
| 2015/0316331 | A1 * | 11/2015 | Kim | F28F 3/044 | 165/81 |
| 2016/0138873 | A1 * | 5/2016 | Dyer | F28D 7/0008 | 165/154 |
| 2016/0169588 | A1 * | 6/2016 | Nett | F28D 7/10 | 165/156 |
| 2016/0363398 | A1 * | 12/2016 | Kim | F28F 27/02 | |

FOREIGN PATENT DOCUMENTS

| | | | | |
|---|---|---|---|---|
| CH | 209014 | A * | 3/1940 | F28D 9/0075 |
| DE | 674738 | C * | 4/1939 | F28D 9/04 |
| DE | 2123741 | A1 * | 11/1972 | F28F 9/22 |
| DE | 2921841 | A1 * | 1/1980 | C01B 17/80 |
| DE | 10357082 | B3 * | 4/2005 | F28D 9/04 |
| DE | 102009011847 | A1 * | 9/2010 | F01K 25/08 |
| DE | 102009014936 | A1 * | 10/2010 | E03C 1/00 |
| EP | 0492031 | A1 * | 7/1992 | F24D 17/001 |
| EP | 1347529 | A2 * | 9/2003 | F28D 9/0012 |
| EP | 2837905 | A1 * | 2/2015 | |
| EP | 2843324 | A1 | 3/2015 | |
| EP | 3179190 | A1 * | 6/2017 | F28D 9/0037 |
| FR | 519633 | A * | 6/1921 | F28D 7/10 |
| FR | 552370 | A * | 4/1923 | F28D 7/106 |
| FR | 817860 | A * | 9/1937 | F28D 7/026 |
| FR | 835161 | A * | 12/1938 | F28D 9/04 |
| FR | 899140 | A * | 5/1945 | F28D 7/106 |
| FR | 983300 | A * | 6/1951 | F28D 7/026 |
| FR | 2077865 | A1 * | 11/1971 | F28F 9/22 |
| GB | 812843 | A * | 5/1959 | F28D 7/026 |
| GB | 1089488 | A * | 11/1967 | F28D 7/026 |
| GB | 1353174 | A * | 5/1974 | F28F 9/22 |
| JP | 60213792 | A * | 10/1985 | F28D 9/0075 |
| JP | 60238690 | A * | 11/1985 | F28D 9/0012 |
| JP | 60256794 | A * | 12/1985 | F28D 9/0075 |
| JP | 01273666 | A * | 11/1989 | F28D 9/0012 |
| JP | 09248165 | A * | 9/1997 | F28D 9/04 |
| JP | 2000074577 | A * | 3/2000 | F28D 9/04 |
| JP | 2001201275 | A * | 7/2001 | F28D 7/022 |
| JP | 4247942 | B2 * | 4/2009 | F28D 7/16 |
| JP | 2012167878 | A * | 9/2012 | F28D 9/0012 |
| WO | WO-2007136379 | A1 * | 11/2007 | F28D 7/0033 |
| WO | WO-2009024153 | A1 * | 2/2009 | F28D 9/0012 |
| WO | WO-2010142552 | A2 * | 12/2010 | F24H 1/43 |
| WO | WO-2011098477 | A1 * | 8/2011 | B08B 7/02 |
| WO | WO-2015015933 | A1 * | 2/2015 | |

OTHER PUBLICATIONS

DE 10357082 B3 English Machine Translation—Retrieved Nov. 2018 (Year: 2003).*

European Search Report for Application No. 16165887.7, dated Nov. 28, 2016. 5 Pages.

* cited by examiner

HEAT EXCHANGERS

FOREIGN PRIORITY

This application claims priority to European Patent Application No. 16165887.7 filed Apr. 18, 2016, the entire contents of which is incorporated herein by reference.

TECHNICAL FIELD

The present disclosure relates to heat exchangers.

BACKGROUND

Heat exchangers are used in a wide range of applications for removing heat from or adding heat to a fluid. Typically alternating flows of hot and cold fluid flow through passageways separated by respective thermally conductive plates, the respective hot and cold fluid flows being connected to respective hot and cold fluid plenums through which the hot and cold fluid flows are conducted to and removed from the heat exchanger. Fins may be arranged within the passageways to improve heat transfer from the fluids to the plates and vice versa.

Typically, the heat exchanger comprises a rectangular section shell in which the heat conductive plates are mounted. In certain high pressure and/or high temperature applications, this may lead to pressure and/or thermal fatigue in the shell, particularly in corner regions thereof, which may be undesirable, requiring repair or replacement of the heat exchanger.

SUMMARY

A heat exchanger disclosed herein comprises a circular section tubular shell. The shell comprises a plurality of first shell openings arranged along a length of the shell and a plurality of second shell openings arranged along a length of the shell. A first fluid plenum is provided on the shell in fluid communication with the first shell openings. A second fluid plenum is provided on the shell in fluid communication with the second shell openings. The heat exchanger further comprises a core extending axially within the tubular shell. The core comprises an axially extending first core passage and an axially extending second core passage isolated from the first core passage. The first core passage comprises a plurality of first core openings and the second core passage comprising a plurality of second core openings. A plurality of thermally conductive plates is mounted between the shell and the core to form a plurality of adjacent first and second flow passages between the core and the shell. Respective first shell openings and first core openings open into respective first flow passages and respective second shell openings and second core openings open into respective second flow passages to conduct the respective first and second fluids between the core and the shell.

The first and second shell openings may be arranged in circumferentially offset rows along the shell. The first and second core openings (50, 52) may be arranged in circumferentially offset rows along the core (6).

The first and second shell openings may be axially offset from one another. The first and second core openings (50, 52) may be axially offset from one another.

Respective first shell and first core openings may be generally radially aligned. Respective second shell and second core openings may be generally radially aligned.

The heat exchanger may further comprising one or more flow blocking elements arranged in each flow passage between adjacent plates (for blocking direct flow between the shell openings and core openings.

The heat exchanger may further comprise one or more baffles arranged in each flow passage between adjacent plates for creating a tortuous flow path between the core openings and the shell openings.

One or more baffles may extend outwardly from the core and one or more baffles may extend inwardly from the shell.

The at least one flow blocking element or baffle may be attached to and space adjacent plates.

At least one fin element may be arranged in the first and second flow passages.

The at least one fin element may be a corrugated, perforated or serrated element.

The at least one fin element may be an annular element.

In arrangements with baffles or flow elements as described above, the at least one fin element may comprise at least one slot for receiving the at least one flow blocking element or baffle.

The core may comprise a tube with an internal partition to form the first and second fluid passages.

The heat exchanger may further comprising a connector at one end of the shell having passages for conducting the first and second fluids to and away from the core passages and the shell plenums.

The connector may comprise a pressure relief valve arranged in a bypass passage between a core passage inlet and a shell plenum outlet, the pressure relief valve operable to open to allow flow through the bypass passage when a fluid pressure exceeds a predetermined maximum value.

BRIEF DESCRIPTION OF DRAWINGS

The disclosure will now be set forth in detail, by way of example only, with reference to the accompanying drawings in which.

DETAILED DESCRIPTION

Figure 1:
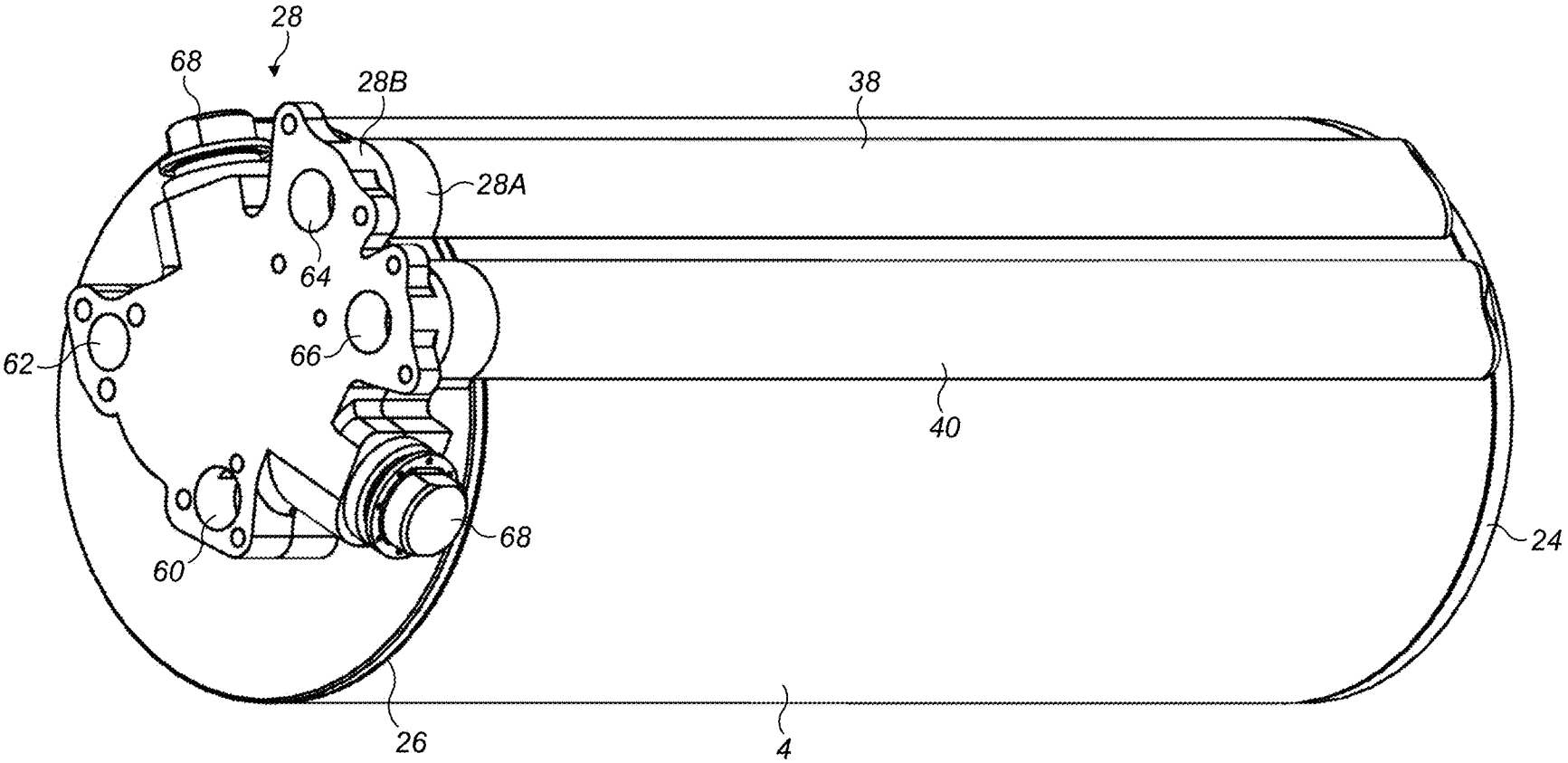
FIG. 1 shows a perspective view of an embodiment of heat exchanger in accordance with the disclosure.
Figure 2:
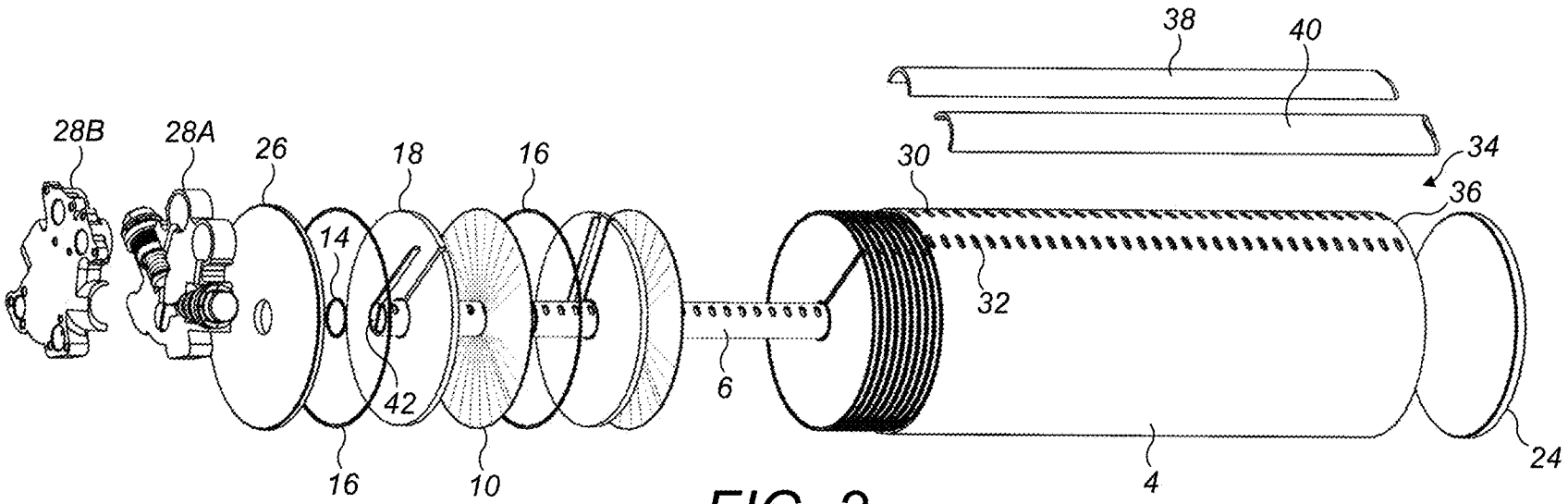
FIG. 2 shows an exploded view of the heat exchanger of FIG. 1.
Figure 3:
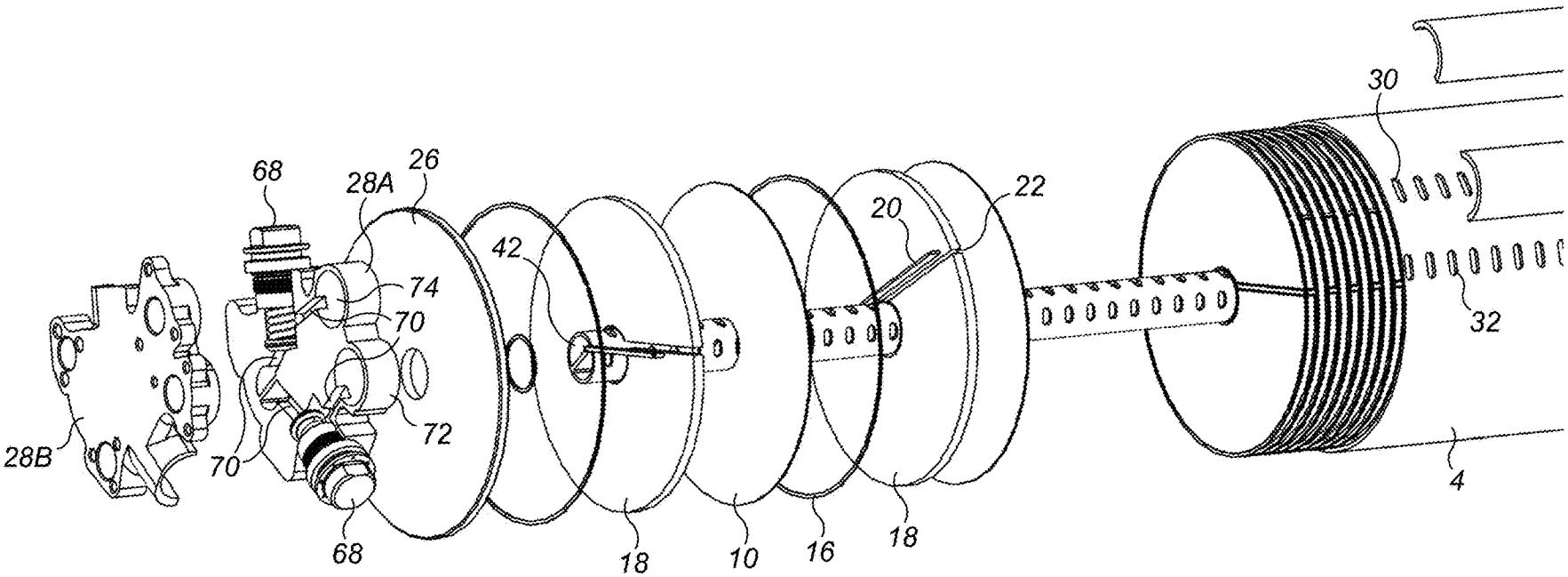
FIG. 3 shows a detail of FIG. 2.
Figure 4:
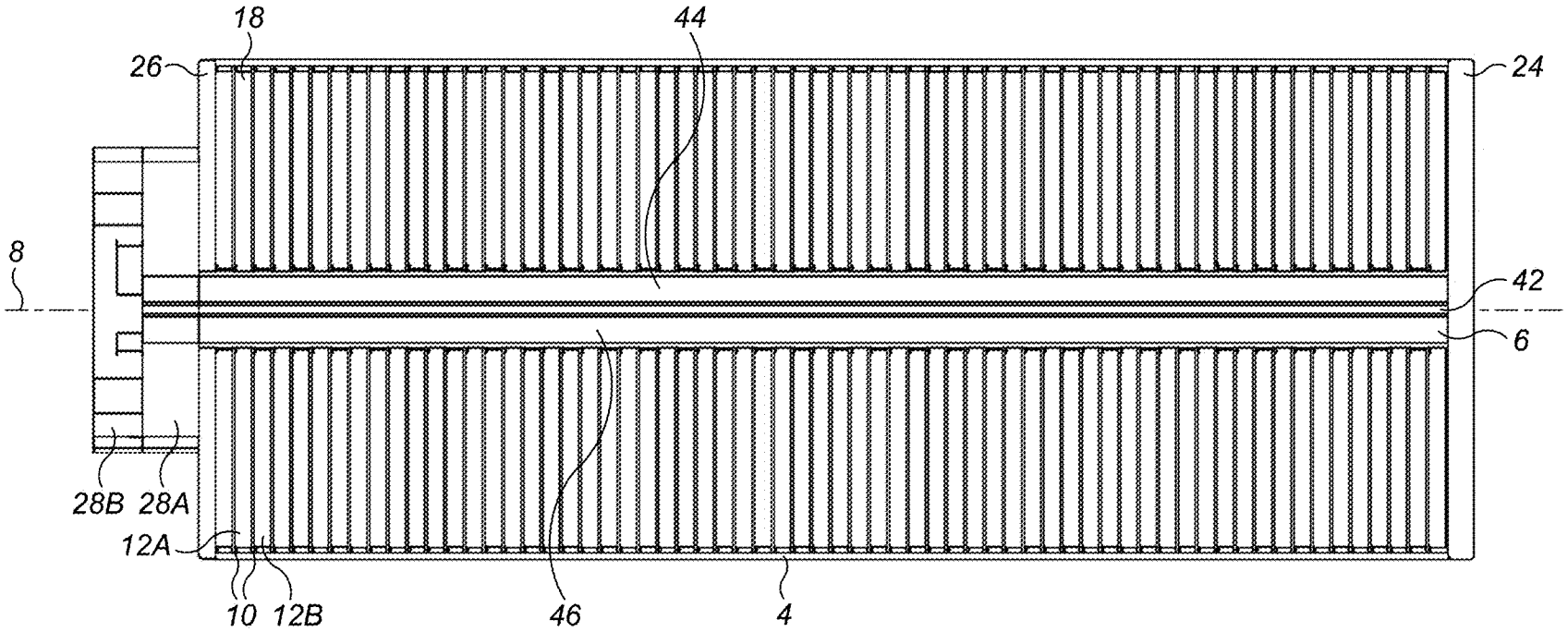
FIG. 4 shows a horizontal section through the heat exchanger of FIG. 1.

With reference to FIGS. 1 to 4, a heat exchanger, specifically a plate fin heat exchanger 2 in accordance with the disclosure is illustrated.

The heat exchanger 2 comprises a tubular shell 4 and a hollow core 6. The shell is circular in cross section and has a longitudinal axis 8. The core 6 is arranged along the longitudinal axis 8 of the shell 4.

A plurality of annular, thermally conductive plates 10 are mounted over the core 6 and extend to the shell 4. The plates 10 are spaced apart axially from each other to define a plurality of flow passages 12A, 12B therebetween. Radially inner and outer annular seals 14, 16 are provided at the inner and outer peripheries of the plates 10 to prevent flow communication between adjacent flow passages 12A, 12B around the plates 10.

Arranged within each flow passage 12 is an annular fin element 18. The fin element 18 may be of a corrugated, perforated or serrated construction, as is known in the heat exchanger art. The opposed faces of the fin elements 18 are in contact with the adjacent plates 10.

The plates 10 are spaced apart by spacers 20 which also act as blocking elements, as will be described further below. The spacers 20 extend through the fin elements 18, which are provided with one or more slots 22 to accommodate the spacers 20.

The heat exchanger 2 is closed at one end by an end plate 24 and at the other end by an end plate 26 having a connector block 28 mounted thereto. The connector block 28, as will be described further below, conducts fluid to and from the heat exchanger 2.

As can be seen in FIGS. 2, 3, 5 and 6, the shell 4 comprises a plurality of first shell openings 30 and a plurality of second shell openings 32. The respective first and second shell openings 30, 32 are arranged in circumferentially spaced apart rows 34, 36. In this embodiment the rows are parallel to one another and extend in a direction parallel to the longitudinal axis 8 of the shell 4. However, in other embodiments, the rows need not be parallel and/or extend parallel to the longitudinal axis.

The first and second shell openings 30, 32 open into respective flow passages 12A, 12B. It will be seen that the first shell openings 30 and second shell openings 32 are also axially offset from one another. Offsetting the openings 30, 32 axially and circumferentially in this manner allows the openings 30 to communicate with alternate flow passages 12. Of course, other arrangements can be envisaged which do not require a circumferentially offset, provided a suitable flow path is provided to the openings 30, 32.

A first fluid plenum 38 is mounted to or formed with the external surface of the shell over the first shell openings 30. A second fluid plenum 40 is mounted to or formed with the external surface of the shell over the second shell openings 32. In this way, respective first and second (hot and cold) fluids may be removed from the respective shell openings 30, 32. The plenums 38, 40 are closed at one end by the end plate 24.

As can also be seen in FIGS. 2 to 6, the core 6 comprises a tube having a central, longitudinally extending partition 42 which divides the core 6 into first and second core passages 44, 46. The partition 42 can be integrally formed with the core 6 or manufactured separately and assembled thereto. The core passageways 44, 46 are closed at one end by the end plate 24.

The core 6 comprises a plurality of first core openings 50 and a plurality of second shell openings 52. The respective first and second shell openings 50, 52 are arranged in circumferentially spaced apart rows 54, 56. In this embodiment the rows are parallel to one another and extend in a direction parallel to the longitudinal axis 8 of the shell 4 and core 6.

The first core openings 50 and second core openings 52 are axially and circumferentially offset from one another and communicate respectively with the first core passage 44 and the second core passage 46. Offsetting the core openings 50, 52 in this manner allows the openings 50, 52 to communicate with alternate flow passages 12A, 12B. Thus a first (for example hot) fluid flow may flow through first core passage 44, first core openings 50, a first set of flow passages 12A, through the first shell openings 30 and the first fluid plenum 38 (see FIG. 5) and a second (for example cold) fluid flow may flow through second core passage 46, second core openings 52, a second set of flow passages 12B, through the second shell openings 32 and the second first fluid plenum 40 (see FIG. 6).

The first and second fluids are conducted to the first and second core passages 44, 46 (which in effect act as core plenums) and away from the first and second plenums 38, 40 via the connector plate 26 at one end of the heat exchanger 2. The connector block 28 is shown in this embodiment as an assembly of two parts 28A, 28B, but other constructions are possible.

The connector block 28 comprises first and second inlets 60, 62 for conducting fluid to the first and second core passages 44, 46. It further comprises third and fourth inlets 64, 66 for conducting fluid from the first and second shell plenums 38, 40. As can be seen most clearly in FIG. 3, the connector block 28 also comprises a pair of adjustable pressure relief valves 68. The pressure relief valves 68 are mounted in respective bypass passages 70 formed between inlets 72 to the core passages 44, 46 and outlets 74 from the shell plenums 38, 40. In this embodiment, the pressure relief valves are configured such that should the pressure in either inlet 72 to the core passages 44, 46 exceed a preset limit, the valve will open, allowing the respective fluid to flow straight from the inlet 74 to the outlet 72 through the bypass passage 70, thereby bypassing the heat exchanger to avoid possible damage thereto.

Having described the construction of the heat exchanger 2, its operation will now be described.

Figure 5:
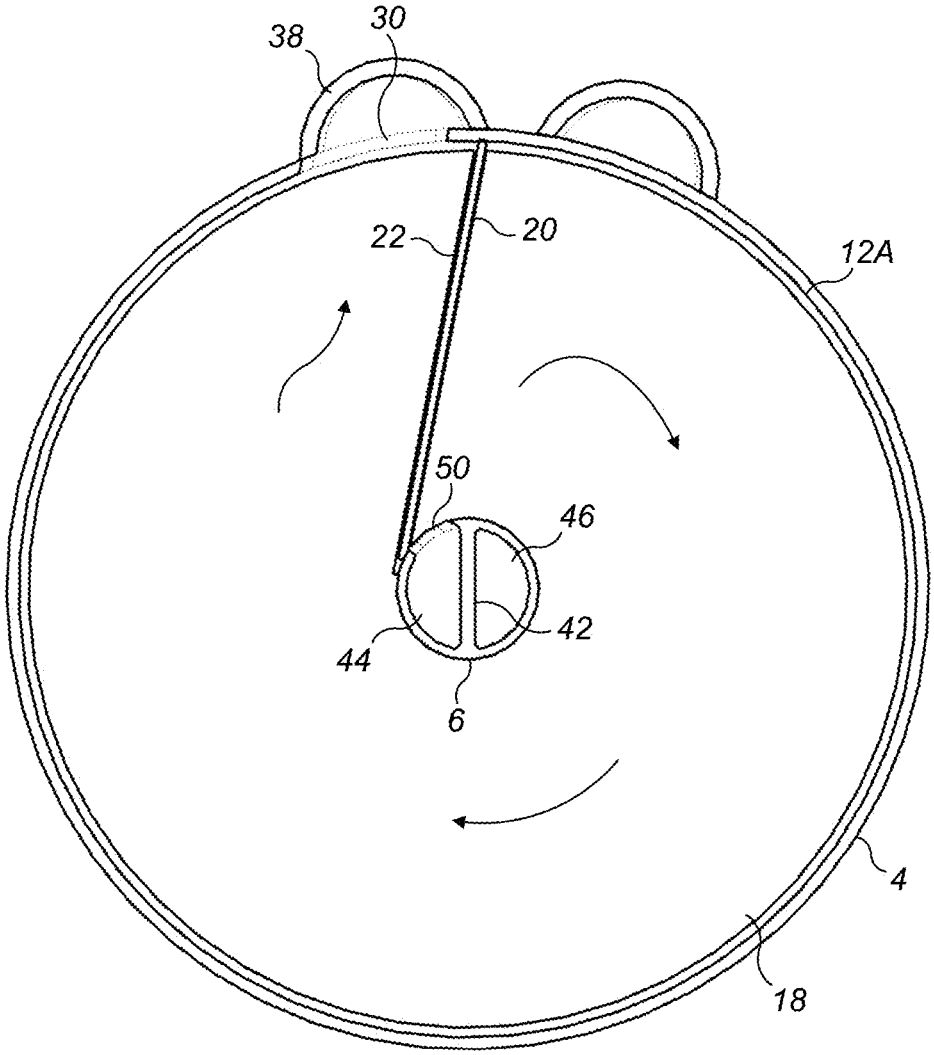
FIG. 5 shows a first vertical section through the through the heat exchanger of FIG. 1.

In this embodiment, a first, for example hot fluid (for example a hot liquid or gas such as air) is admitted to the heat exchanger 2 through the inlet 60. The first fluid then flows into the first core passage 44, out through the first core openings 50 into first flow passages 12A, through the first flow passages 12A and into the first shell plenum 38 via the first shell openings 30. This is illustrated in FIG. 5. As will be seen from that Figure, the spacer 20 extends between the core 6 and the shell 4 from adjacent the first core opening 50 to adjacent the first shell opening 30. The first shell opening 30 and first core opening are generally radially aligned. The spacer 20 acts to block direct communication between the first core opening 50 and the first shell opening 30 and acts as a guide element to guide the fluid around the axis 8. This ensures an elongated flow path through the flow passage (and fin element 18 therewithin) to maximise heat transfer with the adjacent plates 10. The first fluid is then conducted out of the heat exchanger via the first shell plenum 38 and the outlet 64. The radial alignment of the first shell opening 30 and first core opening 50 maximises the length of the flow path.

Figure 6:
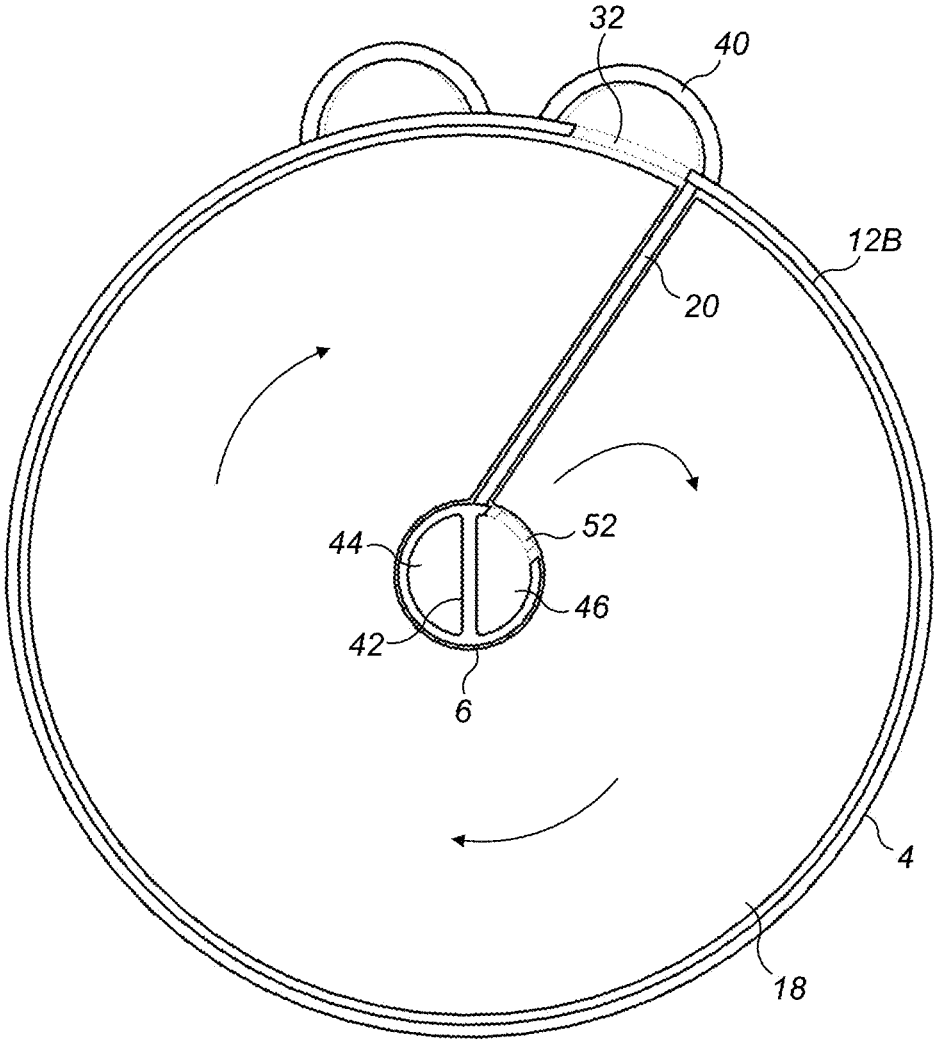
FIG. 6 shows a second vertical section through the through the heat exchanger of FIG. 1.

A second, for example cold, fluid (liquid or gas) is admitted to the heat exchanger 2 through the inlet 62. The second fluid then flows into the second core passage 46, out through the second core openings 52 into flow passages 12B, through the flow passages 12B and into the second shell plenum 40 via the second shell openings 32. This is illustrated in FIG. 6. As will be seen from that Figure, the spacer 20 extends between the core 6 and the shell 4 from adjacent the second core opening 52 to adjacent the second shell opening 32. The second shell opening 32 and second core opening 52 are generally radially aligned. However, the spacer 20 acts to block direct communication between the second core opening 52 and the second shell opening 32 and acts as a guide element to guide the fluid around the axis 8. This ensures an elongated flow path through the flow passage 12B (and fin element 18 therewithin) to maximise heat transfer with the adjacent plates 10. The first fluid is then conducted out of the heat exchanger 2 through the second shell plenum 40 and outlet 62. The radial alignment of the first shell opening 30 and first core opening 50 maximises the length of the flow path.

In this manner, heat exchange can take place between adjacent flow passages 12A, 12B via the intervening plates 10. The presence of fin elements 18 within the flow passages 12A, 12B enhances heat transfer to the plates 10. The circuitous fluid flow path through the flow passages 12A, 12B also enhances heat transfer.

Figure 7:
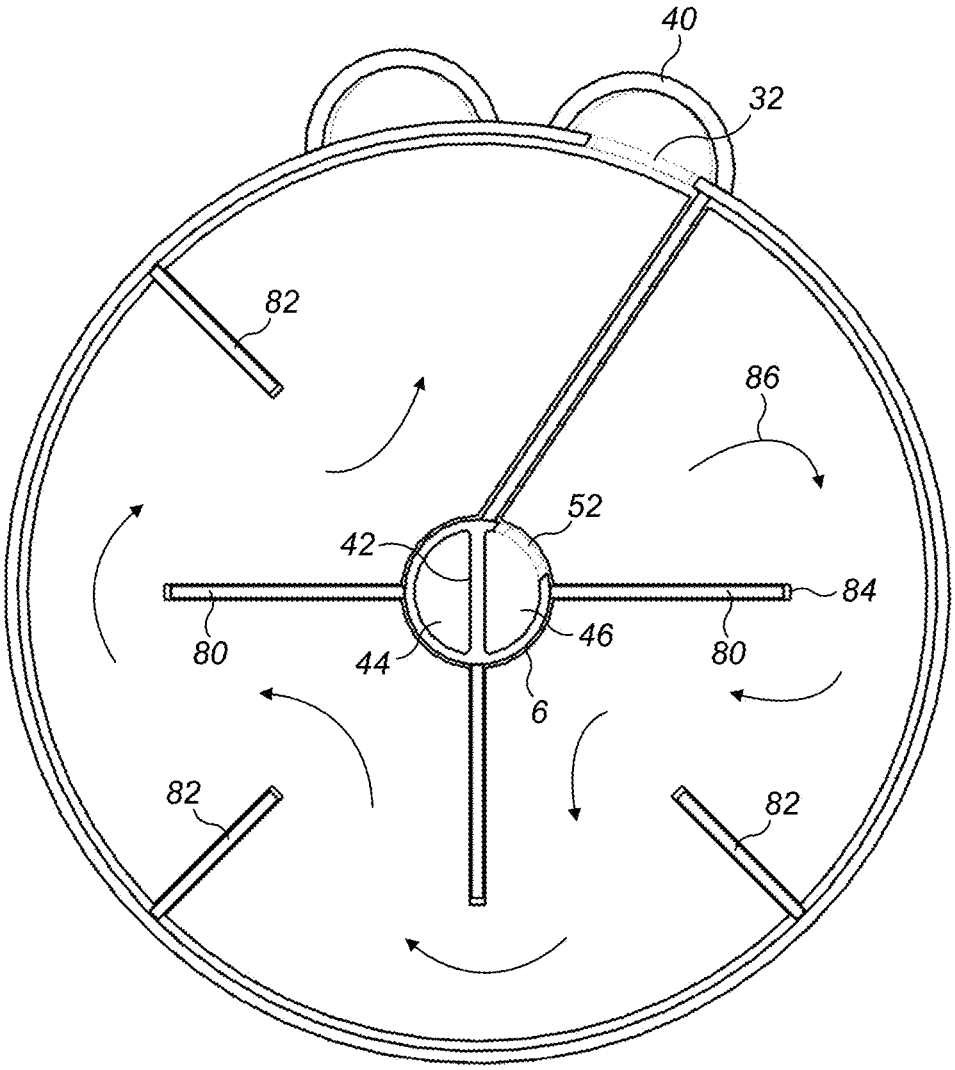
FIG. 7 shows a view similar to that of FIG. 6 for a second embodiment of heat exchanger.

To further enhance heat transfer, the fluids may be encouraged to follow a tortuous flow path through the flow passages 12A, 12B. To achieve this, baffles 80, 82 may be provided in the flow passages 12A 12B. FIG. 7 illustrates one possible arrangement of this type. The baffles 80, 82 are received in slots 84 formed in the fin element 18. In this embodiment, first baffles 80 extend outwardly from the core 6 and second baffles 82 extend inwardly from the shell 4 to create a tortuous flow path 86 between the second core opening 52 and the second shell opening 32. Of course this arrangement is just illustrative and different numbers, positions and orientations of baffles 80, 82 may be provided to provide the desired flow path.

Should the pressure of either fluid entering the heat exchanger 2 exceed a predetermined limit, the respective pressure relief valve 68 will operate allowing the fluid to flow straight from the inlet 72 to the outlet 74 through the bypass passage 70, thereby bypassing the heat exchanger 2 to avoid possible damage thereto.

The materials used in the construction of the heat exchanger 2 will depend on the intended application. Generally the materials will be metallic and the components joined together by brazing and welding (for example the plenums 38, 40 may be welded). In one assembly method, the various components may be suitably assembled with braze, for example a braze paste or a braze coating provided at appropriate interfaces and the assembly then heated to melt the braze and cooled to consolidate the assembly. Materials which may be used include aluminium, or for higher temperature/pressure applications nickel alloys such as Inconel 600 or Inconel 700 or steels.

The described embodiments have the advantage that due to the cylindrical shell construction, stress concentrations in the shell 4, compared to rectangular shell constructions, are considerably reduced. This may mean that the heat exchanger 2 will suffer less from thermal and pressure fatigue, leading to a longer product life and longer times between overhaul. Moreover, the reduced stress levels also mean that less expensive materials such as Aluminium may be used in the construction.

It will be appreciated that the description above is of certain embodiments of the disclosure and that modifications may be made thereto without departing from the scope of the disclosure. For example, while the fluid inlets and fluid outlets are shown at the same end of the heat exchanger 2, they may be provided at opposite ends thereof. Also, the relative positions of the shell openings 30, 32 and core openings 50, 52 may be changed from those illustrated. However, the general radial alignment of the respective shell and core openings is advantageous in maximising the length of the flow path through the flow passages 12A, 12B.

In addition, while the fluid flow through the heat exchanger 2 has been shown as being from the core 6 to the shell 4, in other embodiments the flow may be in the opposite direction. Thus the inlets and outlets described would become outlets and inlets respectively.

Also, while the heat exchanger 2 has been illustrated as having fin elements 18 arranged between adjacent plates 10, this is not essential and the heat exchanger 2 will function without fin elements 18. In such an arrangement, heat would be transferred only by the conductive plates 10. In place of fin elements there would be empty space. This may decrease the thermal conductivity and rigidity of the construction (potentially disadvantageous) but on the other hand may reduce the pressure drop through the heat exchanger which may be advantageous.

Also, in the described embodiments, the first and second flow passages 12A, 12B are alternating. Other arrangements of the flow passages would, however, be possible.

The invention claimed is:

1. A heat exchanger comprising:

a circular section tubular shell comprising:

a plurality of first shell openings arranged along a length of the circular section tubular shell;

a plurality of second shell openings arranged along a length of the circular section tubular shell;

a first fluid plenum provided on the circular section tubular shell in fluid communication with the first shell openings;

a second fluid plenum provided on the circular section tubular shell in fluid communication with the second shell openings;

a core extending axially within the circular section tubular shell and comprising:

an axially extending first core passage and an axially extending second core passage isolated from the first core passage, the first core passage comprising a plurality of first core openings and the second core passage comprising a plurality of second core openings; and a plurality of thermally conductive plates mounted between the circular section tubular shell and the core to form a plurality of adjacent first and second flow passages between the core and the circular section tubular shell;

wherein respective first shell openings and first core openings open into respective first flow passages and respective second shell openings and second core openings open into respective second flow passages to conduct the respective first and second fluids between the core and the shell.

2. The heat exchanger as claimed in claim 1, wherein the first and second shell openings are arranged in circumferentially offset rows along the circular section tubular shell and the first and second core openings are arranged in circumferentially offset rows along the core.

3. The heat exchanger as claimed in claim 1, wherein the first and second shell openings are axially offset from one another and the first and second core openings are axially offset from one another.

4. The heat exchanger as claimed in claim 1, wherein respective first shell and first core openings are radially aligned and respective second shell and second core openings are radially aligned.

5. The heat exchanger as claimed in claim 1, further comprising one or more flow blocking elements arranged in each flow passage between adjacent plates for blocking direct flow between the shell openings and core openings.

6. The heat exchanger as claimed in claim 1, further comprising one or more baffles arranged in each flow passage between adjacent plates for creating a tortuous flow path between the core openings and the shell openings.

7. The heat exchanger as claimed in claim 6, comprising one or more baffles extending outwardly from the core and one or more baffles extending inwardly from the circular section tubular shell.

8. The heat exchanger as claimed in claim 5, wherein the at least one flow blocking element or baffle is attached to and spaces adjacent plates.

9. The heat exchanger as claimed in claim 1, comprising one or more fin elements arranged in the first and second flow passages.

10. The heat exchanger as claimed in claim 9, wherein the at least one fin element is a corrugated, perforated or serrated element.

11. The heat exchanger as claimed in claim 9, wherein the at least one fin element is an annular element.

12. The heat exchanger as claimed in claim 9, wherein the at least one fin element comprises at least one slot for receiving the at least one flow blocking element or baffle.

13. The heat exchanger as claimed in claim 1, wherein the core comprises a tube with an internal partition to form the first and second fluid passages.

14. The heat exchanger as claimed in claim 1, comprising a connector block at one end of the circular section tubular shell having passages for conducting the first and second fluids to and away from the core passages and the circular section tubular shell plenums.

15. The heat exchanger as claimed in claim 14, wherein the connector block comprises a pressure relief valve arranged in a bypass passage between a core passage inlet and a shell plenum outlet, the pressure relief valve operable to open to allow flow through the bypass passage when a fluid pressure exceeds a predetermined maximum value.

* * * * *